US006854365B1

(12) United States Patent
Petts

(10) Patent No.: US 6,854,365 B1
(45) Date of Patent: Feb. 15, 2005

(54) WRENCH

(76) Inventor: Andax Petts, 37 Tulloch Street, Planlands, Queensland 4740 (AU)

( * ) Notice: Subject to any disclaimer, the term of this patent is extended or adjusted under 35 U.S.C. 154(b) by 0 days.

(21) Appl. No.: 10/089,629

(22) PCT Filed: Sep. 27, 2000

(86) PCT No.: PCT/AU00/01173

§ 371 (c)(1),
(2), (4) Date: Mar. 28, 2002

(87) PCT Pub. No.: WO01/23146

PCT Pub. Date: Apr. 5, 2001

(30) Foreign Application Priority Data

Sep. 28, 1999 (AU) ..... PQ 3166

(51) Int. Cl.[7] ..... B25B 13/10
(52) U.S. Cl. ..... 81/170; 81/124.5; 81/178
(58) Field of Search ..... 81/170, 178, 111, 81/186, 124.5, 349

(56) References Cited

U.S. PATENT DOCUMENTS

| | | | | | |
|---|---|---|---|---|---|
| 167,085 | A | * | 8/1875 | Evarts | 81/401 |
| 1,053,891 | A | * | 2/1913 | Steinke | 81/178 |
| 1,493,741 | A | * | 5/1924 | Ellison | 81/170 |
| 2,537,838 | A | * | 1/1951 | Logan | 81/90.2 |
| 6,223,630 | B1 | * | 5/2001 | Stanton | 81/111 |
| 6,412,372 | B1 | * | 7/2002 | Hsu | 81/111 |

FOREIGN PATENT DOCUMENTS

| | | |
|---|---|---|
| DE | 767401 | 2/1957 |
| DE | 1403411 | 10/1963 |
| SE | 628301 | 8/1949 |

OTHER PUBLICATIONS

International Search Report Nov. 1, 2000.

* cited by examiner

*Primary Examiner*—Lee D. Wilson
(74) *Attorney, Agent, or Firm*—Abelman, Frayne & Schwab

(57) ABSTRACT

A wrench 10 including first 11 and second 12 jaw members each having first and second gripping portions 23 for gripping an article to be rotated about a work axis and a leverage portion spaced from the gripping portion, has one or two handles, one handle 13 being connected to the leverage portion of the first jaw member for pivoting movement relative thereto about a leverage axis parallel to the work axis and the other handle 29 (where provided) extending from the leverage portion of the second jaw member in the plane of rotation of the first handle, and an engagement mechanism on the handle for movement therewith for engagement with the leverage portion of the second jaw member to urge the first and second leverage portions apart, and a connector 14 connecting the first and second jaw members and holding them in opposed disposition, the connector being operatively interposed between the respective opposed gripping portions and the opposed leverage portions and being arranged to allow pivoting of the jaw members with respect to each other, the connector being adjustable in length to vary the distance between the gripping portions to suit different sized articles, where the connector is preferably in pivotal engagement with at least one jaw member, and is in the form of a length-adjustable nut and bolt assembly, the nut being in the form of a cylindrical pin having a diametral bore for receiving a length adjustable bolt comprising a sleeve 26 and a screw 27 in threaded engagement with a threaded bore extending axially into the sleeve

25 Claims, 6 Drawing Sheets

WRENCH

FIELD OF INVENTION

THIS INVENTION relates to a wrench.

The invention has particular application to an adjustable wrench of the type which has internally gripping jaws. However, it will be appreciated that the invention is not limited to this particular field of use, and may have application to other tools having movable jaws, such as bolt cutters, nut crackers, or other cutting and/or crushing tools.

BACKGROUND ART

Many types of wrench have been provided for gripping a mechanical element requiring application of torque for rotational movement or holding against rotation. Vise grips, for example, use a pair of jaws with multiple pivot points between the jaws together with a lever arm and over-centre locking arrangement for obtaining a tight grip on an element requiring turning. However, vise grips are sometimes difficult to remove from the article gripped and are limited in the size range of articles for which they are effective.

Multigrips have a wide range of size adjustments, but, for gripping an article, are limited to a simple mechanical advantage resulting from the ratio of the jaw length to the handle length, and a tight grip on the handles is required to maintain sufficient grip on the article.

The present invention aims to provide a wrench which alleviates one or more of the disadvantages of the prior art. Other aims and advantages may hereinafter become apparent.

DISCLOSURE OF INVENTION

With the foregoing in view, in one aspect, this invention resides broadly in a wrench including:

first and second jaw members each having first and second gripping portions for gripping an article to be rotated about a work axis and a leverage portion spaced from said gripping portion;

a handle connected to the leverage portion of the first jaw member for pivoting movement relative thereto about a leverage axis parallel to said work axis;

engagement means on said handle or operatively connected to said handle for movement therewith for engagement with the leverage portion of said second jaw member for urging said first and second leverage portions apart, and connecting means connecting said first and second jaw members and holding them in opposed disposition, the connecting means being operatively interposed between said respective opposed gripping portions and said opposed leverage portions and being arranged to allow pivoting of one of said jaw members relative to the other, the connecting means being adjustable to vary the distance between the gripping portions to suit different sized articles.

In another aspect, the invention resides broadly in a wrench including:

first and second jaw members each having first and second gripping portions for gripping an article to be rotated about a work axis and a leverage portion spaced from said gripping portion;

handle connected to the leverage portion of the first jaw member for pivoting movement relative thereto about a leverage axis parallel to said work axis;

engagement means on said handle or operatively connected to said handle for movement therewith for engagement with the leverage portion of said second jaw member for urging said first and second leverage portions apart;

another handle in fixed relationship to and extending from the leverage portion of the second jaw member, and connecting means connecting said first and second jaw members and holding them in opposed disposition, the connecting means being operatively interposed between said respective opposed gripping portions and said opposed leverage portions and being arranged to allow pivoting of one of said jaw members against the other, the connecting means being adjustable in length to vary the distance between the gripping portions to suit different sized articles.

Preferably the handles are located in the plane of rotation about the work axis. More preferably, the handles are arranged in operative juxtaposition with each other for gripping of both handles by the hand of a user, and such that the handle pivotally attached to the first jaw member may be pivoted towards the other handle to tighten the grip of the gripping portions and away from the other handle to loosen the grip of the gripping portions.

The connecting means is preferably length adjustable and in a preferred form is a length adjustable nut and bolt assembly. In one preferred form, the nut is in the form of a cylindrical pin having a diametral bore for receiving a length adjustable bolt comprising a sleeve and a screw in threaded engagement with a threaded bore extending axially into the sleeve. The nut is in pivotal co-operation with a complementary cylindrical housing provided in the jaw member for pivotal movement about an axis parallel to the work axis. It will be appreciated, however, that other shapes of nut may be provided which still provide pivotal engagement of the connecting means with the jaw member. Additionally, the wrench may be disassembled into its component parts, and in another aspect, the invention provides in the components for the wrench herein described.

Preferably, the nut and bolt assembly is pivotally connected to the first jaw member and the second jaw member includes an aperture for accommodating the length adjustable bolt, and permitting relative, but limited, pivoting movement of the length adjustable bolt within the aperture. More preferably, the aperture is in the form of a tapered bore tapering outwardly to its opening. The limiting of the pivoting may limit the amount of rolling of an article held between the respective jaw members. Preferably, the screw has a head held captive in a head retaining cavity provided in the second jaw member, and some of the perimeter of the head is exposed on one or both sides of the second jaw member for turning in a similar fashion to a thumb wheel. It is also preferred that the head retaining cavity is sized to hold the head captive with a limited degree of free movement axially with respect to the screw and also accommodate the limited degree of pivotal movement determined by the tapering bore in the second jaw member.

Preferably, biasing means is provided operatively connecting the jaw members for biasing the jaw members towards one another. More preferably, the biasing means comprises a coil spring with its respective ends engaging the respective jaw members intermediate the engagement means and the length adjustable bolt assembly means of each jaw member respectively. Preferably, the coil spring is operatively connected to the respective jaw members.

The engagement means is preferably a cam in fixed relationship with the handle and co-operable with an abutment surface on the leverage portion of the second jaw member for urging the leverage portions apart. The cam is preferably located close to the handle's pivotal connection to the first jaw member. The cam is preferably wedge shaped having a section which expands along a curved axis to provide an inner curved face and an outer curved face. Preferably, the inner curved face follows an arcuate course coaxial with the leverage axis, and the outer curved face follows a part spiral course from a pointed distal end outward from the inner face until the outer curved face meets the remainder of the handle. Thus, the cam is horn shaped in section when viewed along the leverage axis.

BRIEF DESCRIPTION OF THE DRAWINGS

In order that the invention may be more readily understood and put into practical effect, reference will now be made to the accompanying drawings which illustrate two embodiments of the invention, and wherein.

DETAIL DESCRIPTION OF THE DRAWINGS

Figure 1:
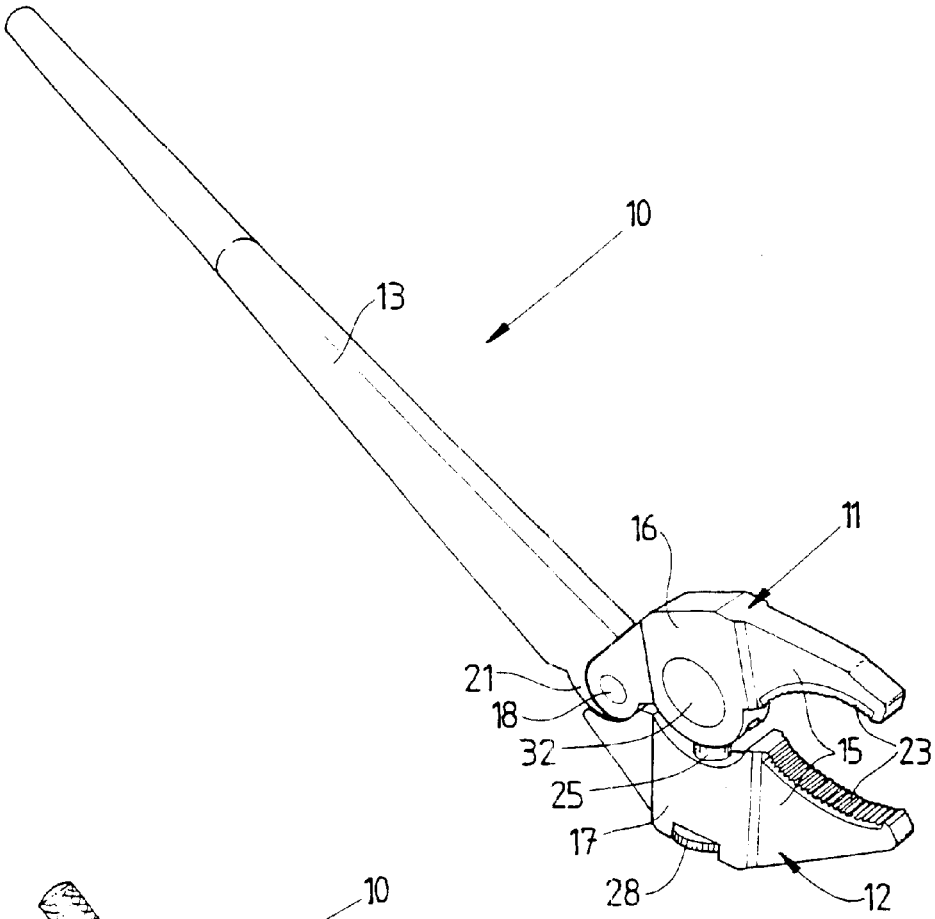
FIG. 1 is a pictorial representation of a wrench according to the invention.
Figure 2:
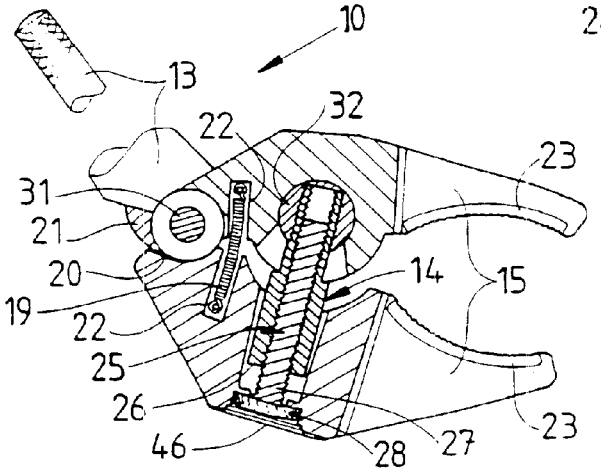
FIG. 2 is a diagrammatic sectional view of the wrench of FIG. 1.

The wrench 10 illustrated in FIGS. 1 and 2 has a first jaw member 11 opposed to a second jaw member 12 and linked thereto by a length adjustable bolt assembly 14. The first and second jaw members each have an arcuate gripping portion 15, each of which is opposed to the other in use. The gripping portion of the first jaw member extends from a first body portion 16 and the gripping portion of the second jaw member extends from a second body portion 17, and each of the gripping portions have a serrated or toothed insert 23 in the form of actuate inserts having axially directed teeth disposed across their respective arcuate inner faces. The first jaw member is pivotally connected to a handle 13 at a main pivot 18. The length adjustable bolt assembly is held in pivotal engagement with the first jaw member by a retaining pin 32 into which a threaded sleeve 26 is inserted, the length adjustable bolt assembly engaging with the first and second body portions as described hereinafter. The threaded sleeve receives an adjusting screw 25. The adjusting screw has a threaded shank 27 and a disc-like head 28, the head being captive as described hereinafter in the second body portion, and a spring 19 is connected between the first and second jaw members and biased to pull the body portions of the jaw members towards each other.

The main pivot is on the other side of the retaining pin 32 from the gripping portion 15. The handle includes a cam 21 which is curved on an inner side to match the curvature of the main pivot and on an outer side is curved to form a curving wedge or horn shaped section, the outer curve of which is arranged to bear against a bearing surface 20 on the second body portion 17 of the second jaw member. The spring 19 is retained in the first and an second jaw members inside a spring retaining aperture 22 in the first and second body portions, and is arranged to have a biasing force urging the body portions of the jaw members towards one another, whereas the cam and bearing surface act together to move the body portions of the jaw members apart, the relative movement between the respective body portions being pivotal by virtue of the retaining pin in the first body portion. Accordingly, part of the body portions remote from the gripping portions may be considered as leverage portions described above.

Figure 3:
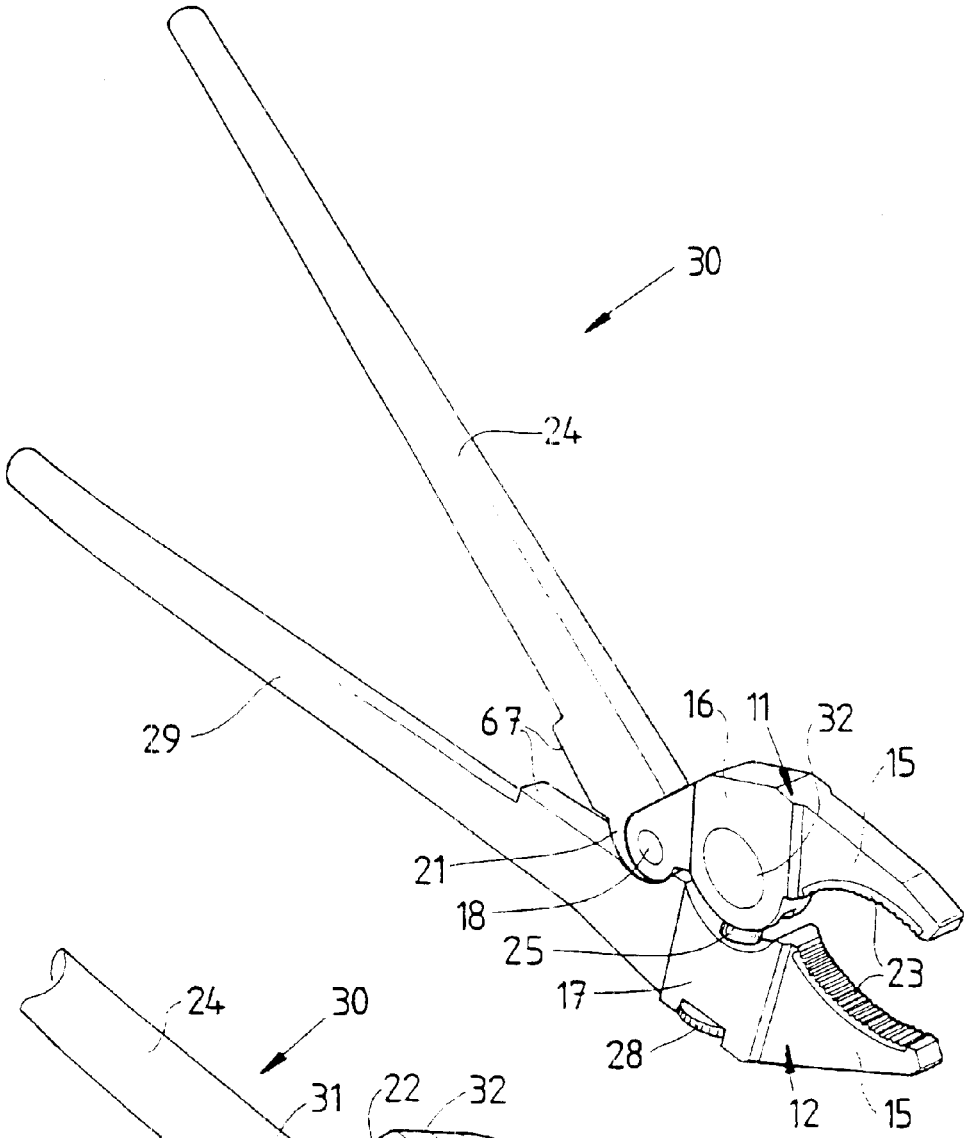
FIG. 3. is a pictorial representation of another wrench according to the invention.
Figure 4:
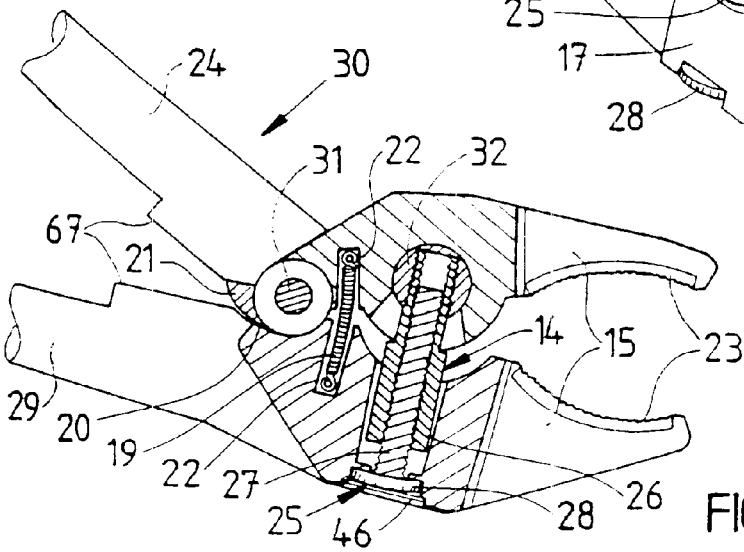
FIG. 4 is a diagrammatic sectional view of the wrench of FIG. 3.

The wrench 30 illustrated in FIGS. 3 and 4 has the same reference numerals for corresponding parts to the one handle wrench described with reference to FIGS. 1 and 2. However, the second jaw member is provided with a second handle 29, and a first handle 24 pivotally connected to the first jaw member is in slightly different form to the handle 13 described with reference to FIGS. 1 and 2. The first and second handles each have a land 67, each land being opposed to the other and arranged to limit the closing of the handles in order to prevent injury to a user, such as pinching of a user's fingers between the handles.

Figure 5:
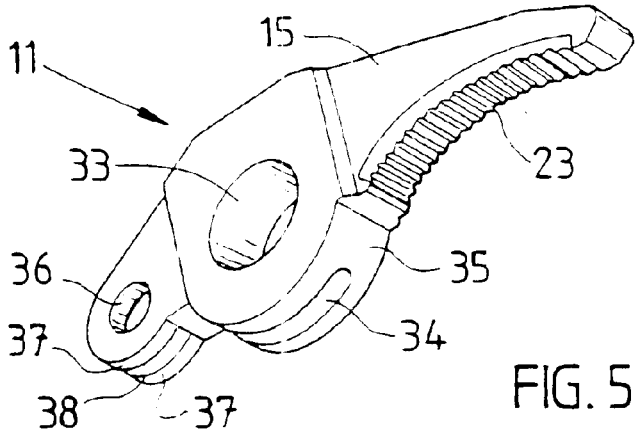
FIG. 5 is a pictorial representation of a first jaw member of the wrenches of FIGS. 1 and 3.

Referring to FIG. 5, the first jaw member has a circular retaining pin socket 33 extending laterally therethrough and penetrating each side of the first body portion 16. In the orientation of the jaw member shown, a slotted opening 34 depends downwardly from the retaining pin socket and opens to the underside of the first jaw member, the slotted opening being segment or wedge shaped and having an arcuate orifice. A spring retaining aperture 22 also opens to the underside of the first jaw member. On the end of the first jaw member remote from the it gripping portion 15, there are two circular pivot lugs 37, each of which are penetrated by a pivot pin aperture 36, the pivot lugs being spaced apart from one another on each side of a slot 38 and being parallel to the retaining pin socket.

Figure 6:
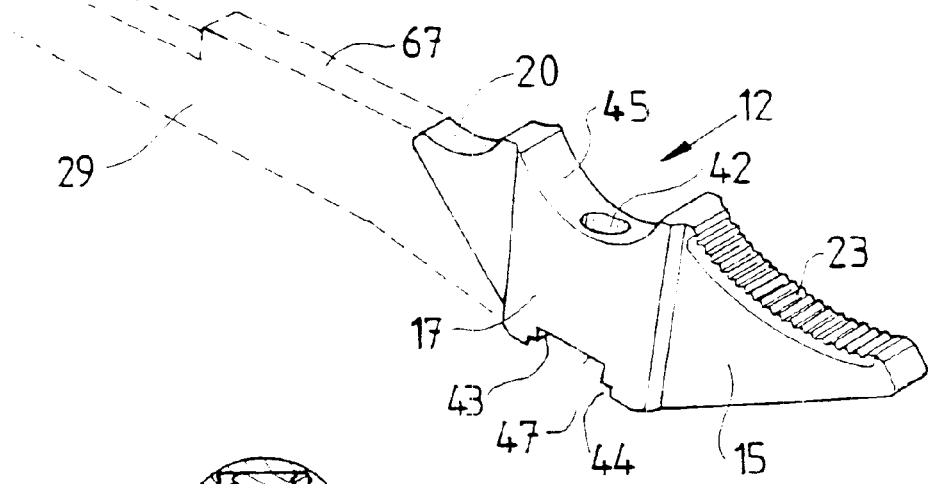
FIG. 6 is a pictorial representation of a second jaw member of the wrench of FIG. 1 with one handle of the wrench of FIG. 3 shown in dashed outline.

Referring to FIG. 6, the second jaw member 12 has an adjustment sleeve aperture 42 penetrating approximately vertically through the first jaw member, and having a counterbore 43 in the lower end of the adjustment sleeve aperture, the counterbore also having an annular base 47 and a plate retaining slot 44 in its cylindrical wall for retaining a cover plate 46 close to the lower most end of the adjustment sleeve aperture 42. The counterbore and the plate retaining slot are of a diameter which is wider than the thickness of the second body portion and accordingly, the counterbore and plate retaining slot both penetrate each side of the second body portion. The adjustment sleeve aperture also has tapering sides (seen more clearly in FIGS. 2 and 4) which permit limited pivoting of the length adjustable bolt assembly therein.

The first jaw member also has a convex mating surface 35 which is an arcuate part of a circle on the lower side of the first jaw member. The convex mating surface matches in radius a concave mating surface 45 on the upper side of the second body portion of the second jaw member 12. The second jaw member 12 also includes the bearing surface 20 which, as can be seen from FIG. 6 is arcuate in form, being a portion of a circle in cross section, the bearing surface being provided on the end of the second body portion remote from the gripping portion 15. The cover plate is preferably an interference fit in the plate retaining slot and formed to be removable therefrom so that, if required, the wrench may be dismantled.

Figure 7:
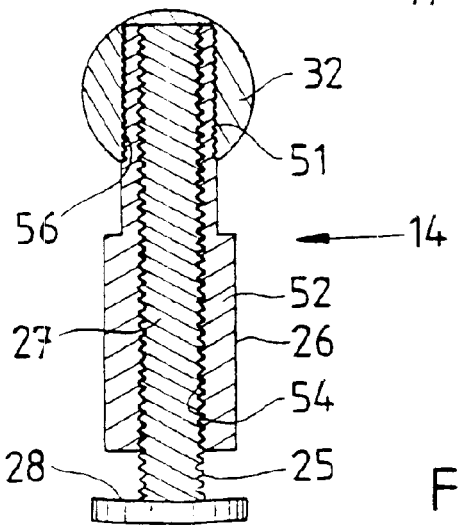
FIG. 7 is a sectional view of a length adjustable bolt assembly of the wrenches of FIGS. 1 and 3.
Figure 8:
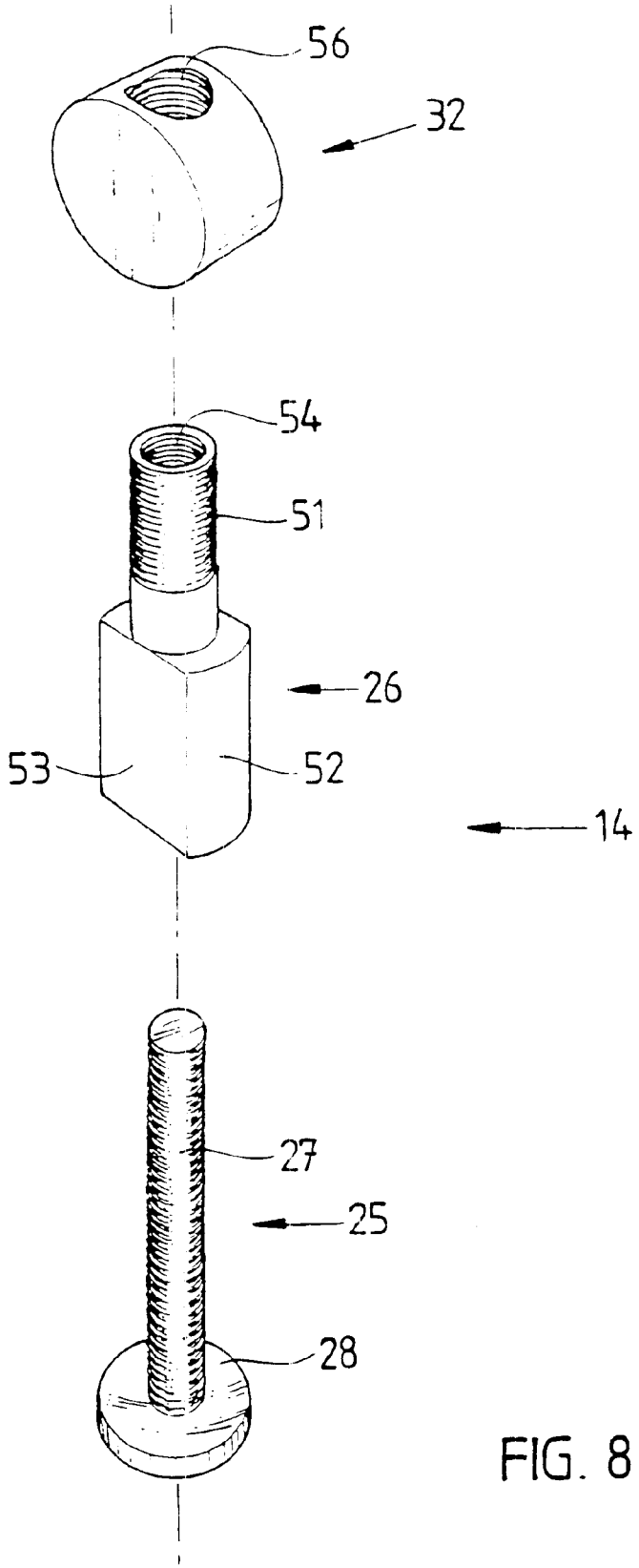
FIG. 8 is an exploded view of the length adjustable bolt assembly of FIG. 7.

The length adjustable bolt assembly 14 is shown assembled in FIG. 7 and its three main parts are shown in FIG. 8 in exploded view. The threaded sleeve 26 has a partly threaded end portion 51 which extends from a flat sided, but otherwise cylindrical, end portion 52 having two opposed parallel flats 53. The threaded sleeve is generally of a cylindrical shape, the diameter of the threaded end portion being the same as the distance between the flats on the flat sided end portion. A threaded internal bore 54 passes axially through the threaded sleeve from one end to the other, penetrating both ends of the threaded sleeve. The threaded bore receives the shank 27 of the adjusting bolt 25, but the head 28 of the adjusting bolt fits inside the counterbore 43 of the second jaw member 12. The diameter of the head is larger than the width of the second jaw member so that part of the head protrudes from the counterbore in the nature of a thumb wheel having a knurled outer circumferential face. Tangential engagement of the head permits the adjusting bolt to be turned about its axis within the threaded bore of the threaded sleeve to move the adjusting bolt axially to adjust the length of the combination of the threaded sleeve and adjusting bolt, the head being captured in the counterbore by the base 47 of the counterbore and the cover plate 46, constraining the second jaw member to move towards or away from the first jaw member with the axial movement of the adjusting bolt into and out of the threaded sleeve. The retaining pin 32 is retained in the retaining pin socket 33 in the first jaw member, the threaded sleeve 26 being retained by threaded engagement in a diametral opening 56 penetrating the retaining pin diametrically, but is a blind opening, stopping just short of penetrating the opposite side. The flats on the flat sided end portion 52 permit the threaded sleeve to be tightened with a tool, such as spanner or adjustable wrench, into the diametral opening on the retaining pin.

Figure 9:
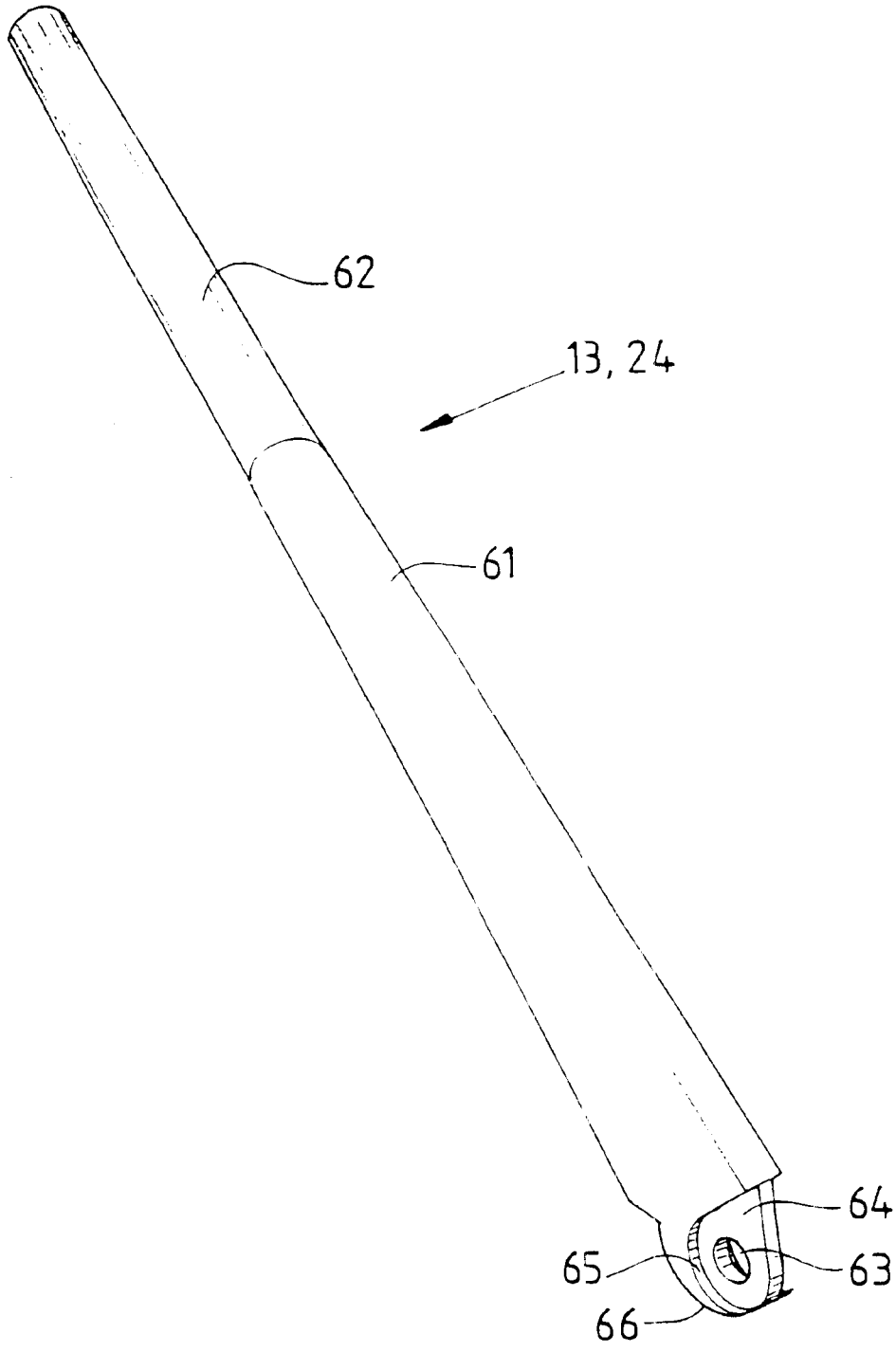
FIG. 9 is a pictorial representation of a pivoting handle of the wrenches of FIGS. 1 and 3.

The handle 13 illustrated in FIG. 9 has a handle shank 61 and a handle grip 62 together making up the bulk of the length of the handle. On the end of the handle shank remote from the handle grip, there is provided an annular handle pivot lug 64 having a handle pivot aperture 63 penetrating sideways therethrough and an annular section matching the pivot lugs 37 on the first jaw member 11. The width of the handle pivot lug is such as to give a clearance fit between the two pivot lugs 37 in the slot 38 so that a pivot pin 31 (shown in FIGS. 1 to 4) can be inserted through the two pivot pin apertures and the handle pin aperture for pivotal connection of the handle to the first jaw member. The cam 21 is provided on the lower side of the handle protruding from the handle shank and having an inner face 65 and an outer face 66, both of which are curved, the inner face of the cam being duplicated on each side of the handle pivot lug, but the outer face being continued on the underside of the handle pivot lug. The curvature of the inner face substantially matches the circumferential curvature of the handle pivot lug and the two pivot lugs on the first jaw member and the outer face has a curvature of larger diameter than the inner face.

Figure 10:
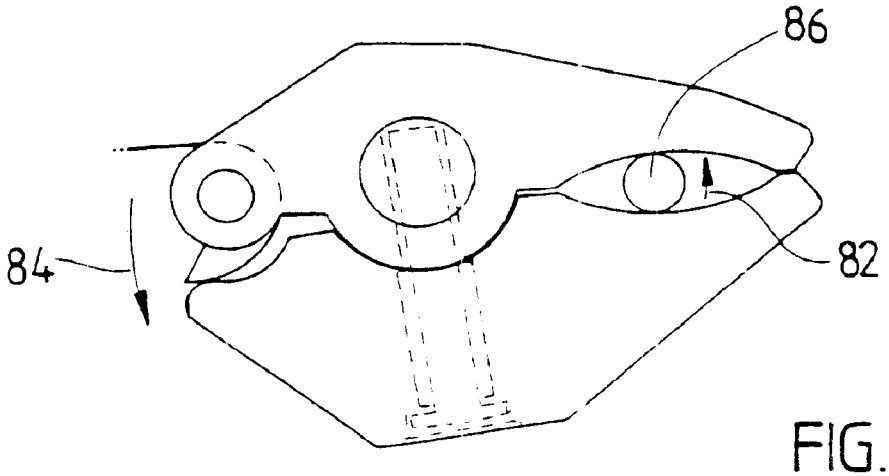
FIG. 10 is a partial side view of the wrench of FIG. 1 showing the jaws closed against a small article.
Figure 11:
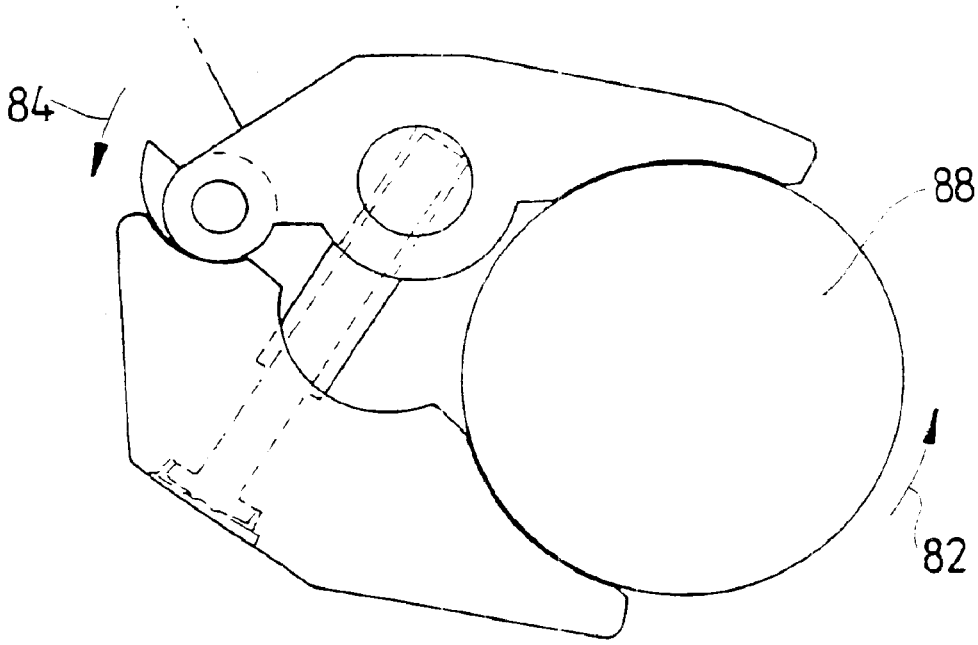
FIG. 11 is a partial side view of the wrench of FIG. 1 showing the jaws closed against a large article.

Referring to FIGS. 10 and 11, the wrench may be used to grasp or grip an article 80 between the first and second jaw members, the tightness of the grip being increased by moving the handle in the direction of arrow 84 which at the same time induces a torque about the axis of the article in direction of arrow 82 and forces the curved surface of the cam harder against the bearing surface. To enhance the tightening of the gripping force, a counter-acting force may be applied to the pivoting end of the handle in the direction of arrow 83. It will be seen that releasing of the grip is achieved by moving the handle in the reverse direction, there being no substantial force to overcome in releasing the jaws from the article.

Referring to FIGS. 1 to 4, and to FIGS. 10 and 11, it can be seen that by screwing the adjusting bolt 25 into the threaded sleeve 26, the first and second jaw members can be drawn together, with action of the handle tightening the grip on a small diameter article 26 having a diameter represented by dimension arrows 87.

By turning the adjusting bolt so that it is screwed outward from the threaded sleeve, the first and second jaw members can be widened to grip a large diameter article 88 having a large diameter represented by dimension arrows 89. Moving the handle in the direction of the arrow 84 not only causes a tightening of the grip of the jaws on the articles, but also imparts a torque in the direction of the arrow 82 in a similar fashion to that described in respect of FIGS. 1 and 2 above.

In each instance, the cam 21 may be inserted between the body portions of each jaw members by pivoting of the handle with respect to the first jaw member, the separating force caused by the outer face of the cam bearing on the bearing surface being accommodated by the head of the adjusting bolt bearing down upon the base of the counterbore, placing the adjusting bolt in tension with respect to the threaded sleeve, the tension in the threaded sleeve being taken up by the retaining pin 32. It will be seen that the wrench of the present invention uses a double lever principle, one lever being the jaw members acting in concert with the connecting means, the load for the lever being the gripping force applied to the article being gripped by the jaw members, the fulcrum being the connecting means restraining the jaw members from moving further apart than the adjusted length of the setting of the adjusting bolt, and the activation of the lever being performed by the action of the cam on the bearing surface. The second lever is the handle in its pivoting relationship with the first jaw member and the wedging action of the cam on the second jaw member, the load being the separating action of the cam on the bearing surface, the fulcrum being the pivoting connection between the handle and the first jaw member, and the activation of the lever being performed by the pivoting of the handle as hereinbefore described.

In the case of the two handle wrench, the length adjustable bolt assembly may be adjusted so that moving the handles together until the mating surfaces of the limiting lands meet. If the article to be gripped is larger than the adjusted separation of the jaw members when the mating surfaces meet, imparting a force on the first handle as described in relation to the one handle wrench will impart a torque on the article being gripped. However, if desired, a reverse torque may be applied to the article being gripped, the tightening of the jaws onto the article being achieved by closing the handles together.

Although the invention has been described with reference to particular examples, it will be appreciated by those skilled in the art that the invention may be embodied in many other forms within the broad scope and ambit of the invention as defined by the following claims.

What is claimed is:

1. A wrench including:

a first jaw member having a first gripping portion and a first leverage portion spaced from said first gripping portion;

a second jaw member having a second gripping portion for gripping and a second leverage portion spaced from said second gripping portion;

said first and second gripping portion being opposed and co-operable with one another for gripping an article to be rotated about a work axis;

a handle operatively connected to the first leverage portion for pivotally moving said first jaw member about a leverage axis parallel to said work axis;

a cam operatively associated with said handle and co-operable with a second abutment face on said second leverage portion and a first abutment face on said fist leverage portion for urging said first and second leverage portion apart; and a connector connecting said first and second jaw members to one another and holding them in opposed disposition, said connector being operatively connected to each jaw member at a location interposed between said respective opposed gripping portions and said opposed leverage portions and being arranged to allow pivoting of one of said jaw members relative to the other, said connector being adjustable to vary the distance between said gripping portions to thereby apply a gripping force to different sized articles.

2. The wrench according to claim 1, wherein the handle is pivotable with respect to said first jaw member in said plane of rotation about said work axis.

3. The wrench according to claim 1, wherein said connector is in pivotal engagement with at least one jaw member.

4. The wrench according to claim 1, wherein the length of said connector is adjustable.

5. The wrench according to claim 1, wherein said connector is in the form of a length-adjustable nut and bolt assembly.

6. The wrench according to claim 5, wherein said nut is in the form of a cylindrical pin having a diametral bore for receiving a length-adjustable bolt comprising a sleeve and a screw in threaded engagement with a threaded bore extending axially into said sleeve.

7. The wrench according to claim 5, wherein said nut and bolt assembly is pivotally connected to said first jaw member and said second jaw member includes a passage for accommodating the length-adjustable bolt and permitting relative limited pivoting movement of said length-adjustable bolt in said passage.

8. The wrench according to claim 5, wherein said passage is formed as a tapered bore said bore tapering outwardly towards said first jaw member.

9. The wrench according to claim 5, wherein said screw has a head held captive in a head retaining-cavity provided in said second jaw member, an said head has a portion of its perimeter exposed one or both sides of said second jaw member for manual rotation.

10. The wrench according to claim 1, that further comprises a biasing spring operatively connecting said jaw member for biasing said jaw members towards one another.

11. The wrench according to claim 1, wherein said cam is in fixed relationship with said first handle and co-operable with an abutment surface on said second leverage portion of said jaw member for urging said first and second leverage portions apart.

12. The wrench according to claim 11, wherein said cam is located in close proximity to the pivotal connection of said first handle to said first jaw member is wedge-shaped along a curved axis to provide an inner curved face which is coaxial with said leverage axis.

13. A wrench including:

a first jaw member having a first gripping portion and a first leverage portion spaced from said first gripping portion;

a second jaw member having a second gripping portion for gripping and a second leverage portion spaced from said second gripping portion;

said first and second gripping portion being opposed and co-operable with one another for gripping an article to be rotated about a work axis;

a first handle connected to the first leverage portion of said first jaw member for pivoting movement relative thereto about a leverage axis parallel to said work axis;

a cam operatively associated with said handle and co-operable with a second abutment face on said second leverage portion for using said first and second apart;

a second handle in fixed relationship to and extending from said second leverage portion of said second jaw member and a connector connecting said first and second jaw members to one another and holding them in opposed disposition, said connector being operatively connected to each jaw member at a location interposed between said respective opposed gripping portions and said opposed leverage portions and being arranged to allow pivoting of one of said jaw members relative to the other, said connector being adjustable to vary the distance between said gripping portions to thereby apply a gripping force to different sized articles.

14. The wrench according to claim 13, wherein said handles are located in the plane of rotation about the work axis.

15. The wrench according to claim 13, wherein said first handle pivotally attached to said first jaw member is pivotable toward said second handle to tighten the grip of said gripping portion and away from said second handle to loosen the grip of said gripping portions.

16. The wrench according to claim 13, wherein said connector is in pivotal engagement with at least one of said jaw members.

17. The wrench according to claim 13, wherein the length of said connector is adjustable.

18. The wrench according to claim 13, wherein said connector is in the form of a length-adjustable nut and bolt assembly.

19. The wrench according to claim 18, wherein said nut is in the form of a cylindrical pin having a diametral bore for receiving a length-adjustable bolt comprising a sleeve and a screw in threaded engagement with a threaded bore extending axially into said sleeve.

20. The wrench according to claim 18, wherein said nut and bolt assembly is pivotally connected to said first jaw member and said second jaw member includes a passage for accommodating the length-adjustable bolt and permitting relative limited pivoting movement of said length-adjustable bolt in said passage.

21. The wrench according to claim 20, wherein said passage is formed as a tapered bore, said bore tapering outwardly towards said first jaw member.

22. The wrench according to claim 19, wherein said screw has a head held captive in a head retaining-cavity provided in said second jaw member, an said head has a portion of its perimeter exposed one or both sides of said second jaw member for manual rotation.

23. The wrench according to claim 13, that further comprises a biasing spring operatively connecting said jaw member for biasing said jaw members towards one another.

24. The wrench according to claim 13, wherein said cam is in fixed relationship with said first handle and co-operable with an abutment on said second leverage portion of said jaw member for urging said first and second leverage portions apart.

25. The wrench according to claim 24, wherein said cam is located proximate to the pivotal connection of said first handle to said first jaw member and is wedge shaped along a curved axis to provide an inner curved face which is coaxial with said leverage axis.

* * * * *